US009478167B2

(12) United States Patent
Kim et al.

(10) Patent No.: US 9,478,167 B2
(45) Date of Patent: Oct. 25, 2016

(54) ORGANIC LIGHT EMITTING DISPLAY AND METHOD FOR DRIVING THE SAME

(71) Applicant: SAMSUNG DISPLAY CO., LTD., Yongin, Gyeonggi-Do (KR)

(72) Inventors: In-Hwan Kim, Yongin (KR); Min-Cheol Kim, Yongin (KR); Byung-Geun Jun, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

(21) Appl. No.: 14/537,098

(22) Filed: Nov. 10, 2014

(65) Prior Publication Data

US 2015/0130690 A1 May 14, 2015

(30) Foreign Application Priority Data

Nov. 14, 2013 (KR) ..... 10-2013-0137994

(51) Int. Cl.
*G09G 3/30* (2006.01)
*G09G 3/32* (2016.01)

(52) U.S. Cl.
CPC .... *G09G 3/3233* (2013.01); *G09G 2300/0819* (2013.01); *G09G 2300/0842* (2013.01); *G09G 2320/02* (2013.01); *G09G 2330/028* (2013.01)

(58) Field of Classification Search
CPC ..... G09G 3/3258; G09G 3/3233; G09G 3/3266; G09G 3/3291; G09G 2320/02; G09G 2320/028; G09G 2300/0819; G09G 2300/0842
See application file for complete search history.

(56) References Cited

U.S. PATENT DOCUMENTS

2012/0162184 A1* 6/2012 Kim ..... G09G 3/3655 345/212
2013/0241808 A1* 9/2013 Kwon ..... H02M 3/158 345/76

FOREIGN PATENT DOCUMENTS

KR 10-2007-0102015 A 10/2007
KR 10-2013-0026780 A 3/2013
KR 10-2013-0053060 A 5/2013

* cited by examiner

*Primary Examiner* — Towfiq Elahi
(74) *Attorney, Agent, or Firm* — Lee & Morse P.C.

(57) ABSTRACT

An organic light emitting display includes a power supply source and a power voltage compensation unit. The power supply source supplies at least a first power voltage to a first power voltage line of the display. The power voltage compensation unit to generate a first compensation power voltage based on the first power voltage and a feedback power voltage from the first power voltage line. The first power voltage compensation unit outputs the first compensation power voltage to the first power voltage line.

18 Claims, 5 Drawing Sheets

ORGANIC LIGHT EMITTING DISPLAY AND METHOD FOR DRIVING THE SAME

CROSS-REFERENCE TO RELATED APPLICATION

Korean Patent Application No. 10-2013-0137994, filed on Nov. 14, 2013, and entitled: "Organic Light Emitting Display And Method For Driving The Same," is incorporated by reference herein in its entirety.

BACKGROUND

1. Field

One or more embodiments described herein relate to a display device and method for driving the same.

2. Description of the Related Art

The performance of displays must increase as information technology evolves. Flat panel displays have been developed in pursuit of this goal. One type of flat panel display, known as an organic light emitting diode (OLED) display, has pixels which output light based on a recombination of electrons and holes in corresponding active layers. Displays of this type have demonstrated relatively fast response speed, low-voltage driving and power consumption, and excellent viewing angle.

One type of OLED display includes a plurality of pixels disposed in a matrix form, a scan driver for supplying scan signals to scan lines of the display panel, a data driver for supplying data voltages to data lines of the display panel, and a power supply source for supplying a plurality of power voltages to the display panel. The power voltages may include a high-potential voltage, a low-potential voltage, and a reference voltage.

Each pixel includes an OLED, a driving transistor for controlling drain-source current according to a data voltage supplied to a gate electrode thereof, and a scan transistor for supplying a data voltage of a data line to the gate electrode of the driving transistor in response to a scan signal of a scan line. The OLED emits light according to the drain-source current of the driving transistor.

The reference voltage is a voltage supplied to the gate electrode of the driving transistor, before the data voltage is supplied to the gate electrode of the driving transistor. That is, the gate electrode of the driving transistor is initialized to the reference voltage before the data voltage is supplied.

However, the reference voltage may be influenced by noise in the display panel. Consequently, the reference voltage supplied from the power supply source may include noise. As a result, the gate electrode of the driving transistor in each pixel may not be initialized to a voltage different from the reference voltage supplied from the power supply source. This may cause a voltage different from the data voltage to be charged in the gate electrode of the driving transistor in each pixel. Consequently, the OLED in each pixel emits light with a luminance different from the luminance corresponding to the data voltage. That is, each pixel expresses a gray scale value different from the gray scale value corresponding to the data voltage, as a result of noise in the display panel. Picture quality is therefore lowered.

SUMMARY

In accordance with one embodiment, an organic light emitting display includes a display panel including data lines, scan lines, power voltage lines, and pixels arranged at intersections of the data lines and the scan lines; a data driver to output data voltages to the data lines; a scan driver to output scan signals to the scan lines; a power supply source to supply at least a first power voltage to a first power voltage line; and a first power voltage compensation unit to generate a first compensation power voltage based on the first power voltage and a first feedback power voltage from a first power voltage line, the first power voltage compensation unit to output the first compensation power voltage to the first power voltage line.

The first power voltage compensation unit may include an inverting amplifying unit to inversely amplify a difference between the first feedback power voltage and the first power voltage; and a non-inverting amplifying unit to non-inversely amplify a difference between the first power voltage and an output voltage of the inverting amplifying unit.

The inverting amplifying unit may include a first operational amplifier (OP-AMP) including an inverting input terminal to receive the first feedback power voltage, a non-inverting input terminal to receive the first power voltage, and an output terminal; a first resistor coupled to the inverting input terminal of the first OP-AMP; and a first variable resistor coupled between the inverting input terminal and the output terminal of the first OP-AMP.

The non-inverting amplifying unit may include a second OP-AMP including an inverting input terminal to receive the first power voltage, a non-inverting input terminal to receive the output voltage of the inverting amplifying unit, and an output terminal; a second resistor coupled to the inverting input terminal of the second OP-AMP; and a second variable resistor coupled between the inverting input terminal and the output terminal of the second OP-AMP.

The first power voltage compensation unit may include a variable resistance control unit to output a variable resistance control signal to control resistance values of the first and second variable resistors. The variable resistance control unit may include a first smoothing circuit to reduce a number of ripples of the output voltage of the inverting amplifying unit; a second smoothing circuit configured to reduce a number of ripples of an output voltage of the non-inverting amplifying unit; a first integrating circuit to output a first integration value by integrating the output voltage of the inverting amplifying unit during a first period; a second integrating circuit to output a second integration value by integrating the output voltage of the non-inverting amplifying unit during the first period; and a comparator to output the variable resistance control signal based on a comparison of the first and second integration values.

The comparator may output a variable resistance control signal of a first logic level when the first integration value is greater than the second integration value, and outputs a variable resistance control signal of a second logic level when the first integration value is less than the second integration value.

Each of the first and second variable resistors may have a first resistance value when the variable resistance control signal of the first logic level is input, and has a second resistance value less than the first resistance value when the variable resistance control signal of the second logic level is input.

Each pixel may include a scan transistor to supply a data voltage of a data line in response to a scan pulse of a scan line; a driving transistor to control a drain-source current based on the data voltage supplied to a gate electrode of the driving transistor; and an organic light emitting diode to emit light based on the drain-source current of the driving transistor. The first power voltage may be a reference voltage supplied to the gate electrode of the driving transistor before the data voltage is supplied to the gate electrode of the driving transistor.

In accordance with another embodiment, a method for driving an organic light emitting display may include receiving a first power voltage from a power supply source; receiving a first feedback power voltage from a first power voltage line; generating a first compensation power voltage based on the first power voltage and the first feedback power voltage; and outputting the first compensation power voltage to the first power voltage line.

Generating the first compensation power voltage may include inversely amplifying a difference between the first feedback power voltage and the first power voltage; and non-inversely amplifying a difference between the first power voltage and an output voltage of the inverting amplifying unit.

Generating the first compensation power voltage may include outputting a variable resistance control signal to control the resistance value of a first variable resistor of an inverting amplifying unit and the resistance value of a second variable resistor of a non-inverting amplifying unit.

Outputting of the variable resistance control signal may include reducing a number of ripples of the output voltage of the inverting amplifying unit; reducing a number of ripples of an output voltage of the non-inverting amplifying unit; outputting a first integration value obtained by integrating the output voltage of the inverting amplifying unit during a first period; outputting a second integration value obtained by integrating the output voltage of the non-inverting amplifying unit during the first period; and outputting the variable resistance control signal based on a comparison of the first and second integration values.

Outputting the variable resistance control signal may include outputting a variable resistance control signal of a first logic level when the first integration value is greater than the second integration value, and outputting a variable resistance control signal of a second logic level when the first integration value is less than the second integration value.

Each of the first and second variable resistors may have a first resistance value when the variable resistance control signal of the first logic level is input, and a second resistance value less than the first resistance value when the variable resistance control signal of the second logic level is input.

The display may include a plurality of pixels and each of the pixels may include: a scan transistor to supply a data voltage of a data line in response to a scan pulse of a scan line; a driving transistor to a control drain-source current based on the data voltage supplied to a gate electrode of the driving transistor; and an organic light emitting diode configured to emit light based on the drain-source current of the driving transistor.

The first power voltage may be a reference voltage supplied to the gate electrode of the driving transistor before the data voltage is supplied to the gate electrode of the driving transistor.

In accordance with another embodiment, a compensator includes a first input to receive a first power voltage; a second input to receive a feedback power voltage; and a circuit to generate a compensation power voltage based on the first power voltage and the first feedback power voltage, wherein the first power voltage is to be provided to an organic light emitting display and the feedback power voltage is received from the display, and wherein the circuit outputs the compensation power voltage to a power voltage line of the display. The compensation power voltage is output to reduce variation in luminance of pixels in the display.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1:
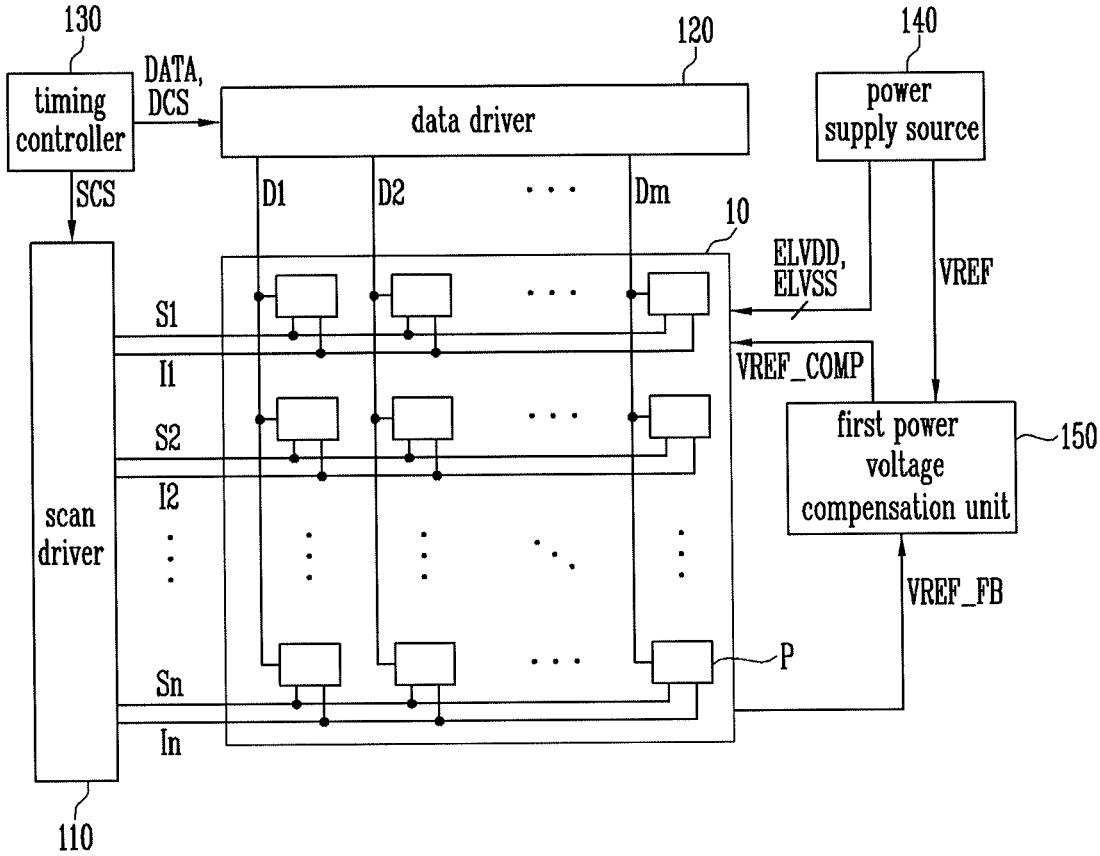
FIG. 1 illustrates an embodiment of an organic light emitting display.

FIG. 1 illustrates an embodiment of an organic light emitting display which includes a display panel 10, a scan driver 110, a data driver 120, a timing controller 130, a power supply source 140, and a first power voltage compensation unit 150.

The display panel 10 includes data lines D1 to Dm (m is a natural number of 2 or more) and scan lines S1 to Sn (n is a natural number of 2 or more) that intersect to each other. In addition, initialization signal lines I1 to In are parallel to the scan lines S1 to Sn in the display panel 10. Although FIG. 1 illustrates that only the initialization signal lines I1 to In are used as signal lines parallel to the scan lines S1 to Sn, a plurality of control signal lines parallel to the scan lines S1 to Sn may be further formed in the display panel 10, in addition to the initialization signal lines I1 to In. Pixels P are arranged in a matrix form at intersection portions of the data lines D1 to Dm and scan lines S1 to Sn.

The scan driver 110 includes a scan signal output unit and an initialization signal output unit. Each of the scan signal output unit and the initialization signal output unit may include a shift register for sequentially generating an output signal, a level shifter for shifting the output signal of the shift register to a swing width suitable for driving a transistor of the pixel P, and an output buffer.

The scan signal output unit sequentially outputs scan signals to the scan lines S1 to Sn of the display panel 10. The initialization signal output unit sequentially outputs initialization signals to the initialization lines I1 to In of the display panel 10. When the control signal lines are arranged to be parallel to the scan lines S1 to Sn in the display panel 10, the scan driver 110 may include a plurality of control signal output units for outputting control signals to the plurality of control signal lines.

The data driver 120 includes at least one source driver integrated circuit (IC). The source drive IC receives a digital video data DATA input from the timing controller 130. The source drive IC generates data voltages by converting the digital video data DATA into a gamma compensation voltage, in response to a data timing control signal DCS from the timing controller 130. The generated data voltages are supplied to the data lines D1 to Dm of the display panel 10. Accordingly, the data voltages are supplied to pixels P to which the scan signals are supplied.

The timing controller 130 receives a digital video data DATA from a host system through an interface, such as a low voltage differential signaling (LVDS) interface or a transition minimized differential signaling (TMDS) interface. The timing controller 130 receives timing signals, which, for example, may include a vertical synchronization signal, a horizontal synchronization signal, a data enable signal, and/or a dot clock input from the host system.

The timing controller 130 generates timing control signals for controlling operation timing of the scan driver 110 and data driver 120 based on the timing signal. The timing control signals include a scan timing control signal SCS for controlling the operation timing of the scan driver 110, and a data timing control signal DCS for controlling the operation timing of the data driver 120. The timing controller 130 outputs the scan timing control signal SCS to the scan driver 110, and outputs the data timing control signal DCS and the digital video data DATA to the data driver 120.

The power supply source 140 receives a predetermined voltage from a battery of the organic light emitting display and/or an external power supply source, and supplies a plurality of power voltages. The power supply source 140 supplies a first power voltage VREF to the first power voltage compensation unit 150. The power supply source 140 supplies a second power voltage ELVDD to a second power voltage line of the display panel 10, and supplies a third power voltage ELVSS to a third power voltage line of the display panel 10.

The first to third power voltages VREF, ELVDD and ELVSS may correspond to DC power voltages. In one embodiment, the DC power voltages may have different levels from each other. For example, the first power voltage may be a reference voltage for initializing a gate electrode of a driving transistor in each pixel P. The second power voltage may be a high-potential voltage. The third power voltage may be a low-potential voltage. Although FIG. 1 illustrates that the power supply source 140 supplies the first to third power voltages VREF, ELVDD and ELVSS, in an alternative embodiment the power supply source 140 may supply another DC power voltage to the display panel 10, in addition to the first to third power voltages VREF, ELVDD and ELVSS.

The power voltage supply source 140 may be implemented to include, for example, a DC-DC integrated circuit. The first and second power voltage lines of the display panel 10 are coupled to the pixels P, and the third power voltage line of the display panel 10 is coupled to a cathode electrode of an OLED in each pixel P.

The power supply source 140 may supply a gate-on voltage and a gate-off voltage to the scan driver 110. The gate-on voltage is a turn-on voltage of transistors in each pixel P of the display panel 10. The gate-off voltage is a turn-off voltage of transistors in each pixel of the display panel 10.

The first power voltage compensation unit 150 receives the first power voltage VREF from the power supply source 140, and receives a first feedback power voltage VREF_FB from the first power voltage line. The first power voltage compensation unit 150 generates a first compensation power voltage VREF_COMP based on the first power voltage VREF and first feedback voltage VREF_FB, and outputs the first compensation voltage VREF_COMP to the first power voltage line of display panel 10.

Figure 5A:
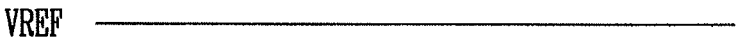
FIGS. 5A to 5D illustrate a first power voltage supplied from a power supply source, a first feedback power voltage fed back from a display panel, an output voltage of an inverting amplifying unit in the first power voltage compensation unit, a first compensation power voltage compensated by the first power voltage compensation unit, and the first compensation power voltage in which noise of the display panel is offset.
Figure 5B:
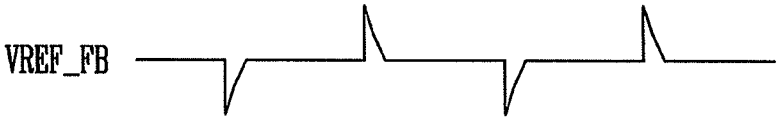
Figure 5C:
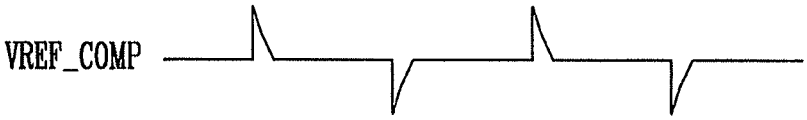
Figure 5D:
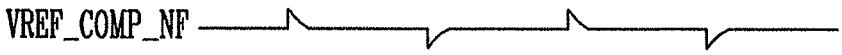

As shown in FIG. 5B, the first feedback power voltage VREF_FB corresponds to a voltage influenced, for example, by non-specific noise of the display panel 10. As shown in FIG. 5D, the first compensation power voltage VREF_COMP corresponds to a voltage generated by reflecting noise of the display panel 10. In a case where the first compensation power voltage VREF_COMP is supplied to the display panel 10, noise of the first compensation power voltage VREF_COMP is offset by noise of the display panel 10.

The first compensation power voltage VREF_COMP may have a voltage level equal to the first reference voltage VREF, and may be a power voltage which hardly has noise. Thus, in this embodiment, the first compensation power voltage VREF_COMP (obtained by compensating for noise of the display panel 10) is supplied to the first power voltage line, in order to prevent a reduction in picture quality caused by noise in the display panel 10.

Figure 2:
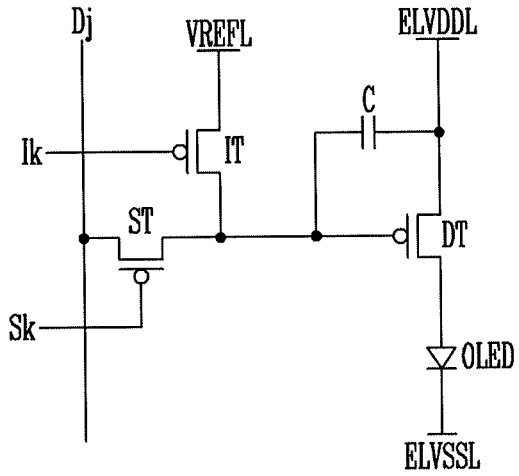
FIG. 2 illustrates an embodiment of a pixel in FIG. 1.

FIG. 2 illustrates an embodiment of pixel P which includes an OLED, a driving transistor DT, a scan transistor ST, an initialization transistor IT, and at least one capacitor C. The driving transistor DT controls drain-source current Ids which flows through a channel of thereof, based on a voltage of its gate electrode. As the difference between a gate-source voltage of the driving transistor DT and the threshold voltage of the driving transistor DT increases, the drain-source current Ids of the driving transistor DT increases. (The gate-source voltage refers to a voltage difference between the gate and source electrodes of the driving transistor DT).

The OLED is coupled between the driving transistor DT and a third power voltage line ELVSSL. The OLED emits light according to the drain-source current Ids of the driving transistor DT. The luminance of light emitted by the OLED may be in proportion to the drain-source current Ids of the driving transistor DT.

The scan transistor ST supplies a data voltage of a j-th (j is a natural number satisfying $1 \leq j \leq m$) data line Dj, in response to a scan signal supplied from a k-th (k is a natural number satisfying $1 \leq k \leq n$) scan line Sk. When the scan transistor ST is turned on, the data voltage is supplied to the gate electrode of the driving transistor DT.

The initialization transistor IT supplies first compensation power voltage VREF_COMP from a first power voltage line VREFL, in response to an initialization signal from a k-th initialization line Ik. When the initialization transistor IT is turned on, the first compensation power voltage VREF_COMP is supplied to the gate electrode of the driving transistor DT.

The capacitor C is coupled between the gate electrode of the driving transistor DT and a second power voltage line ELVDDL.

A semiconductor layer of each of the driving transistor DT, the scan transistor ST, and the initialization transistor IT may be formed, for example, of a-Si, oxide, or poly silicon. Although FIG. 2 illustrates that the driving transistor DT, scan transistor ST, and initialization transistor IT are P-type metal oxide semiconductor field effect transistors (MOSFETs), these transistors may be N-type MOSFETs in other embodiments.

The pixel P is operated during one frame period, which includes an initialization period, a data voltage supply period, and an emission period. The initialization period refers to a period in which the gate electrode of the driving transistor DT is initialized to the first compensation power voltage VREF_COMP. The data voltage supply period refers to a period in which the data voltage is supplied to the driving transistor DT. The emission period refers to a period in which the OLED emits light.

FIG. 2 shows only one possible embodiment of pixel P. In other embodiments, may have a different structure which includes OLED, driving transistor DT, scan transistor ST, initialization transistor IT, and the at least one capacitor C.

Figure 3:
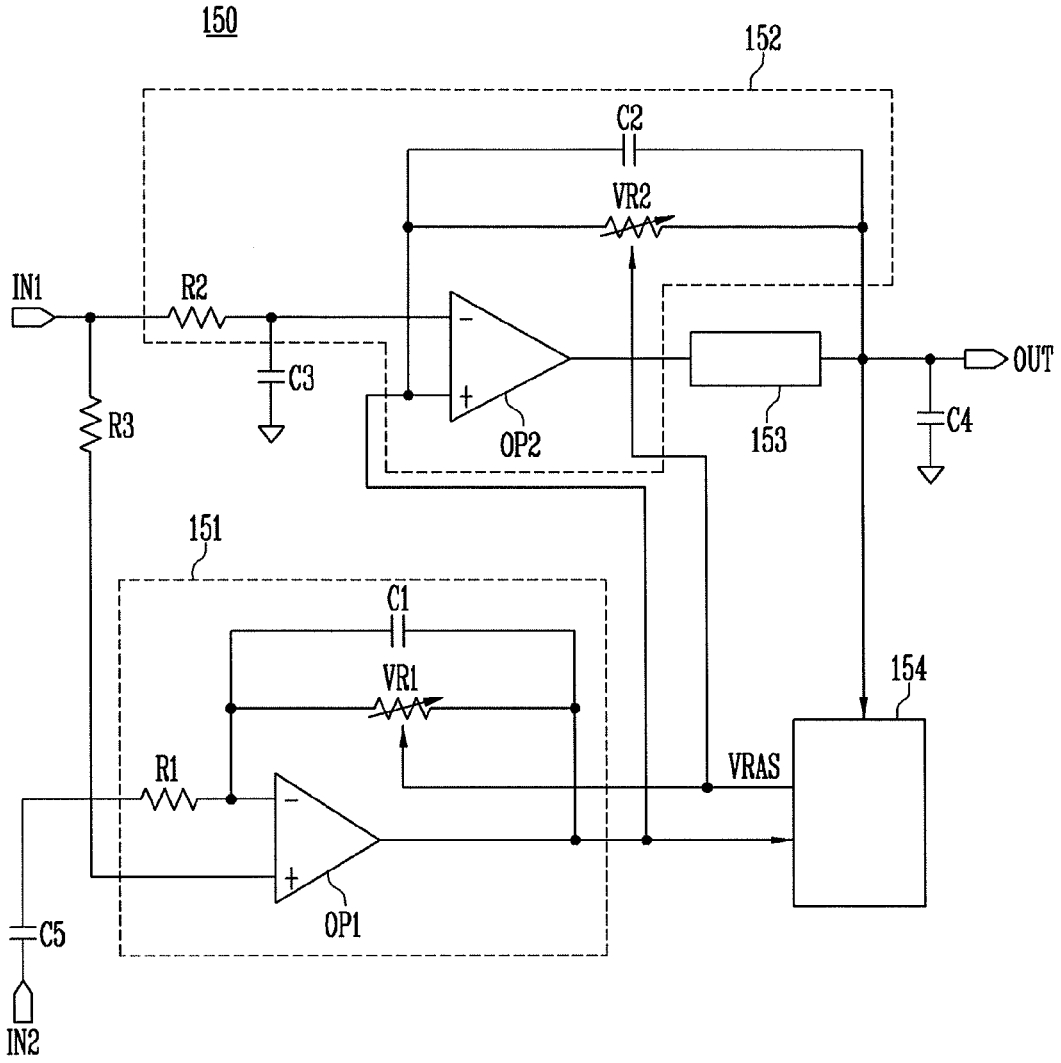
FIG. 3 illustrates an embodiment of a first power voltage compensation unit.

FIG. 3 illustrates an embodiment of the first power voltage compensation unit 150 of FIG. 1. Referring to FIG. 3, first power voltage compensation unit 150 includes an inverting amplifying unit 151, a non-inverting amplifying unit 152, an analog buffer 153, and a variable resistance control unit 154.

The first power voltage VREF from the power supply source 140 is input to a first input terminal IN1 of the first power voltage compensation unit 150. The first feedback power voltage VREF_FB, from the first power voltage line VREFL of the display panel 10, is input to a second input terminal IN2 of the first power voltage compensation unit 150. An output terminal OUT of the first power voltage compensation unit 150 outputs the first compensation power voltage VREF_COMP to the first power voltage line VREFL of the display panel 10.

The inverting amplifying unit 151 inversely amplifies the voltage difference between the first feedback power voltage VREF_FB input through the second input terminal IN2 and the first power voltage VREF input through the first input terminal IN1. In this embodiment, the inverting amplifying unit 151 includes a first operational amplifier (OP-AMP) OP1, a first resistor R1, a first variable resistor VR1, and a first capacitor C1.

The first OP-AMP OP1 includes a non-inverting input terminal (+) coupled to the first input terminal IN1, an inverting input terminal (−) coupled to the second input terminal IN2, and an output terminal. Thus, the first power voltage VREF corresponding to a DC power voltage is input to the non-inverting input terminal (+) of the first OP-AMP OP1. The first feedback voltage is input to the inverting input terminal (−) of the first OP-AMP OP1.

The first resistor R1 is coupled between the inverting input terminal (−) of the first OP-AMP OP1 and the second input terminal IN2. The first variable resistor VR1 and the first capacitor C1 are coupled in parallel between the inverting input terminal (−) and the output terminal of the first OP-AMP OP1.

As shown in Equation 1, the first OP-AMP OP1 inversely compensates for a difference between the first feedback power voltage VREF_FB input to the inverting input terminal (−) of the first OP-AMP OP1 and the first power voltage VREF input to the non-inverting input terminal (+) of the first OP-AMP OP1 at a first amplification ratio. The first OP-AMP OP1 then outputs the compensated difference.

$$Vout1 = Vp1 + \left(\frac{V_{VR1}}{V_{R1}}\right) \times (Vp1 - Vn1) \quad (1)$$

In Equation 1, Vout1 denotes an output voltage output to the output terminal of the first OP-AMP OP1, Vp1 denotes a first power voltage VREF input to the non-inverting input terminal (+) of the first OP-AMP OP1, and Vn denotes a first feedback power voltage VREF_FB input to the inverting input terminal (−) of the first OP-AMP OP1. In addition, $V_{VR1}$ denotes a resistance value of the first variable resistor VR1 and $V_{R1}$ denotes a resistance value of the first resistor R1.

The first amplifying ratio is $V_{VR1}/V_{R1}$, and may be controlled by varying the resistance value $V_{VR1}$ of the first variable resistor VR1. The resistance value $V_{VR1}$ of the first variable resistor VR1 may be controlled in response to a variable resistance control signal VRAS of the variable resistance control unit 154.

The non-inverting amplifying unit 152 non-inversely amplifies the voltage difference between the first power voltage VREF input through the first input terminal IN1 and the output voltage Vout1 of the inverting amplifying unit 151. The non-inverting amplifying unit 152 includes a second OP-AMP OP2, a second resistor R2, a second variable resistor VR2, and a second capacitor C2.

The second OP-AMP OP2 includes an inverting input terminal (−) coupled to the first input terminal IN1, a non-inverting input terminal (+) coupled to the output terminal of the inverting amplifying unit 151, and an output terminal. Thus, the first power voltage VREF corresponding to a DC power voltage is input to the inverting input terminal (−) of the second OP-AMP OP2. The output voltage Vout1 of the inverting amplifying unit 151 is input to the non-inverting input terminal (+) of the second OP-AMP OP2.

The second resistor R2 is coupled between the inverting input terminal (−) of the second OP-AMP OP2 and the first input terminal IN1. The second variable resistor VR2 and the second capacitor C2 are coupled in parallel between the inverting input terminal (−) of the second OP-AMP OP2 and the output terminal.

As shown in Equation 2, the second OP-AMP OP2 non-inversely compensates for a difference between the first power voltage VREF input to the inverting input terminal (−) of the second OP-AMP OP2 and the output voltage Vout1 of the inverting amplifying unit 151, input to the non-inverting input terminal (+) of the second OP-AMP OP2 at a second amplification ratio. The second OP-AMP OP2 outputs the compensated difference.

$$Vout2 = Vp2 + \left(\frac{V_{VR2}}{V_{R2}}\right) \times (Vn2 - Vp2) \quad (2)$$

In Equation 2, Vout2 denotes an output voltage output to the output terminal of the second OP-AMP OP2, Vp2 denotes an output voltage Vout1 of the inverting amplifying unit 151, input to the non-inverting input terminal (+) of the second OP-AMP OP2, and Vn denotes a first power voltage VREF input to the inverting input terminal (−) of the second OP-AMP OP2. In addition, $V_{VR2}$ denotes a resistance value of the second variable resistor VR2, and $V_{R2}$ denotes a resistance value of the second resistor R2.

The second amplifying ratio is $V_{VR2}/V_{R2}$, and may be controlled by varying the resistance value $V_{VR2}$ of the second variable resistor VR2. The resistance value $V_{VR2}$ of the second variable resistor VR2 may be controlled in response to a variable resistance control signal VRAS of the variable resistance control unit 154.

The analog buffer 153 may be coupled between the output terminal of the non-inverting amplifying unit 152 and the output terminal OUT of the first power voltage compensation unit 150. The variable resistance control unit 154 receives the output voltage Vout1 of the inverting amplifying unit 151 and the output voltage Vout2 of the non-inverting amplifying unit 152.

The variable resistance control unit 154 compares the output voltage Vout1 of the inverting amplifying unit 151 with the output voltage Vout2 of the non-inverting amplifying unit 152. The variable resistance control unit 154 then controls the resistance value of each of the first and second variable resistances VR1 and VR2 by outputting the variable resistance control signal VRAS, based on the comparison result. The variable resistance control unit 154 will be described in detail with reference to FIGS. 6 and 7.

The first power voltage compensation unit 150 may further include an input stabilization filter C3, an output stabilization filter C4, a high pass filter C5, and a third resistor R3. The input stabilization filter C3 may be coupled between the first input terminal IN1 and the inverting input terminal (−) of the first OP-AMP OP1. The input stabilization filter C3 filters ripples of the first power voltage VREF input through the first input terminal IN1.

The output stabilization filter C4 may be coupled between the analog buffer 153 and the output terminal OUT of the first power voltage compensation unit 150. The output stabilization filter C4 filters ripples of the output voltage Vout2 of the non-inverting amplifying unit 152.

The high pass filter C5 may be coupled between the second input terminal IN2 and the first resistor R1 of the inverting amplifying unit 151. The high pass filter C5 filters a DC component of the first feedback power voltage VREF_FB input through the second input terminal IN2.

The third resistor R3 may be coupled between the first input terminal IN1 and the non-inverting input terminal (+) of the first OP-AMP OP1. The third resistor R3 eliminates jitter of the first power voltage VREF input through first input terminal IN1.

Figure 4:
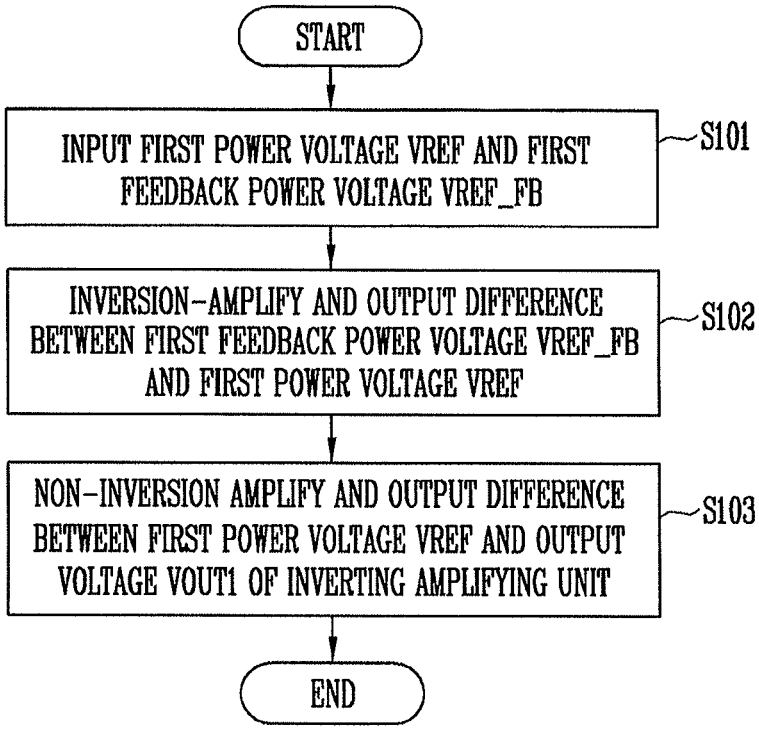
FIG. 4 illustrates an embodiment of a method for compensating a first power voltage of the first power voltage compensation unit.

FIG. 4 illustrates an embodiment of a method of compensating for the first power voltage of the first power voltage compensation unit 150 in FIG. 1 FIGS. 5A to 5D illustrate waveforms of the first power voltage from the power supply source, the first feedback power voltage fed back from the display panel, the output voltage of the inverting amplifying unit in the first power voltage compensation unit, the first compensation power voltage compensated by the first power voltage compensation unit, and the first compensation power voltage in which noise of the display panel is offset. For illustrative purposes, the method of FIG. 4 is described with reference to FIGS. 3, 4 and 5A to 5D.

First, the first power voltage VREF from the power supply source 140 is input to the first input terminal IN1 of the first power voltage compensation unit 150. The first feedback power voltage VREF_FB from the first power voltage line VREFL of the display panel 10 is input to the second input terminal IN2 of the first power voltage compensation unit 150. The first power voltage VREF corresponds to a DC power voltage having a predetermined level, as shown in FIG. 5A.

The first feedback power voltage VREF_FB is a voltage influenced by noise of the display panel 10, as shown in FIG. 5B. That is, the voltage supplied to the first power voltage line VREFL of the display panel 10 corresponds to the DC power voltage having a predetermined level, as shown in FIG. 5A, but includes noise of the display panel, as shown in FIG. 5B. (See operation S101 in FIG. 4).

Second, the inverting amplifying unit 151 of the first power voltage compensation unit 150 inversely amplifies and outputs the difference between the first feedback power voltage VREF_FB and the first power voltage VREF, using the first OP-AMP OP1 in accordance with Equation 1.

In this case, the first amplification ratio of the inverting amplifying unit 151 is $V_{VR1}/V_{R1}$ as shown in Equation 1. This ratio may be controlled, for example, by varying the resistance value $V_{VR1}$ of the first variable resistor VR1. In one embodiment, the resistance value $V_{VR1}$ of the first variable resistor VR1 is controlled in response to a variable resistance control signal VRAS of the variable resistance control unit 154. (See operation S102 in FIG. 4).

Third, the non-inverting amplifying unit 152 non-inversely amplifies and outputs the difference between the first power voltage VREF and the output voltage Vout1 of the inverting amplifying unit 151, using the second OP-AMP OP2 in accordance with Equation 2.

In this case, the second amplification ratio of the non-inverting amplifying unit 152 is $V_{VR2}/V_{R2}$ as shown in Equation 2. This ratio may be controlled by varying the resistance value $V_{VR2}$ of the second variable resistor VR2. The resistance value $V_{VR2}$ of the second variable resistor VR2 may be controlled, for example, in response to a variable resistance control signal VRAS of the variable resistance control unit 154. The output signal Vout2 of the non-inverting amplifying unit 152, which passes through the analog buffer 153 and output stabilization filter C4, is output as the first compensation power voltage VREF_COMP through the output terminal OUT, as shown in FIG. 5C. (See operation S103 in FIG. 4).

As shown in FIGS. 5B and 5C, the first compensation power voltage VREF_COMP (output through the output terminal OUT of the first power voltage compensation unit 150) may have a waveform obtained by inverting the first feedback power voltage VREF_FB. Therefore, when the first compensation power voltage VREF_COMP is supplied to the display panel 10, noise of the first compensation power voltage VREF_COMP is offset by noise of the display panel 10. The first compensation power voltage VREF_COMP NF (having noise is offset by noise of the display panel 10) may have the same voltage level as the first reference voltage REF, as shown in FIG. 5D, thereby producing a power voltage which hardly has any noise.

As a result, in this embodiment, the first compensation power voltage VREF_COMP (obtained by compensating for noise of the display panel 10) is supplied to the first power voltage line VREFL. It is therefore possible to prevent deterioration of picture quality caused by noise of the display panel 10.

Figure 6:
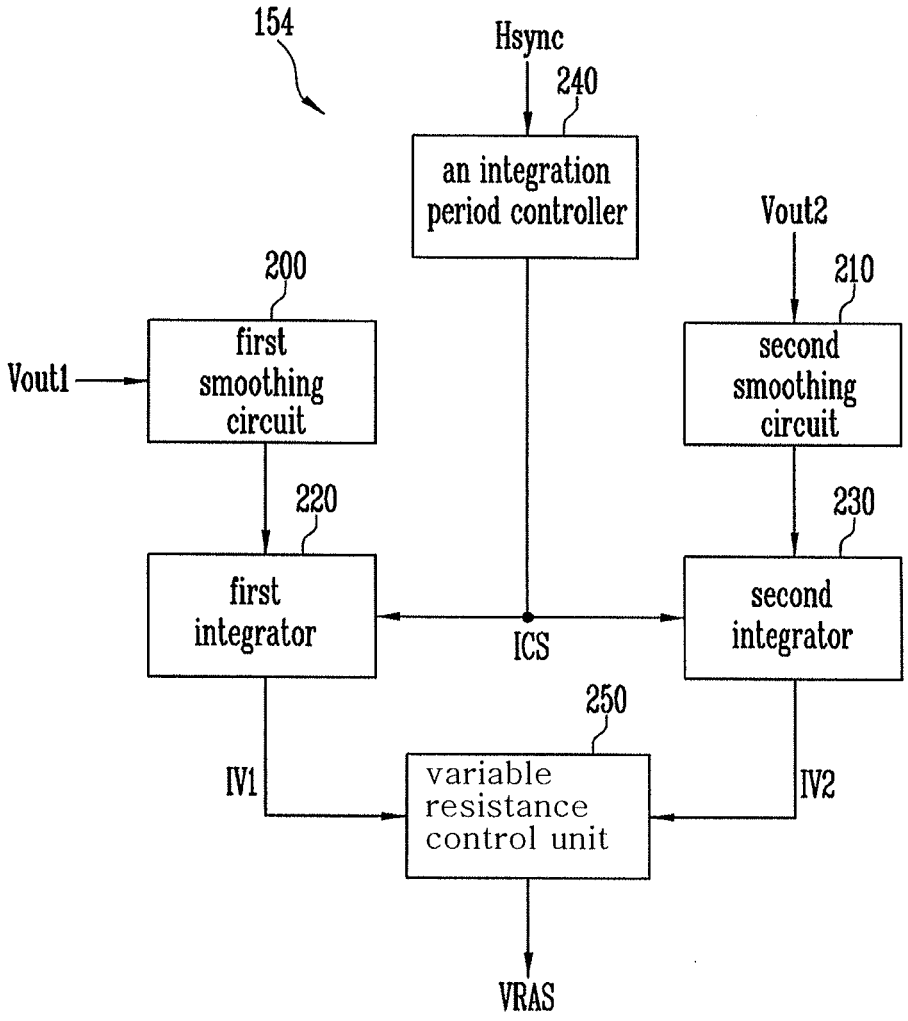
FIG. 6 illustrates an embodiment of a variable resistance control unit.

FIG. 6 illustrates an embodiment of variable resistance control unit 154 in FIG. 3. Referring to FIG. 6, the variable resistance control unit 154 includes a first smoothing circuit 200, a second smoothing circuit 210, a first integrator 220, a second integrator 230, an integration period controller 240, and a comparator 250. The variable resistance control unit 152 compares the output voltage Vout1 of the inverting amplifying unit 151 and the output voltage Vout2 of the non-inverting amplifying unit 152. The variable resistance control unit 152 controls the resistance value of each of the first and second variable resistors VR1 and VR2 by outputting the variable resistance control signal VRAS, based on the compared result.

Figure 7:
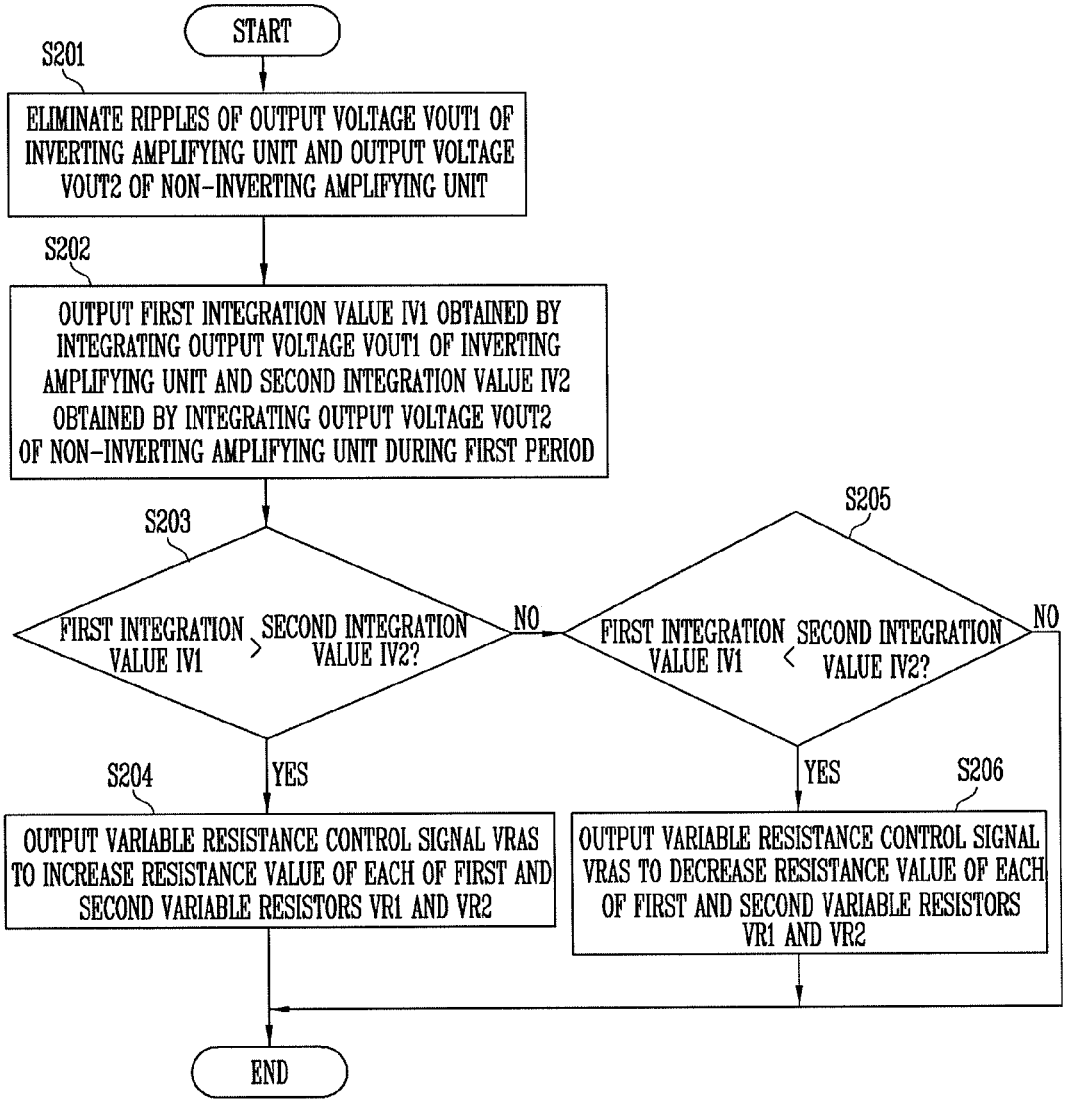
FIG. 7 illustrates an embodiment of a method for controlling a variable resistance of the variable resistance control unit.

FIG. 7 illustrates an embodiment of a method for controlling the variable resistance of the variable resistance control unit in FIG. 6. First, the first smoothing circuit 200 receives an output voltage Vout1 of the inverting amplifying unit 151, and reduces or eliminates the number of ripples of the output voltage Vout1 of the inverting amplifying unit 151. The second smoothing circuit 210 receives an output voltage Vout2 of the non-inverting amplifying unit 152, and reduces or eliminates the number of ripples of the output voltage Vout2 of the non-inverting amplifying unit 152. (See operation S201 in FIG. 7).

Second, the first integrator 220 receives an integration period control signal (ICS) input from the integration period controller 240. The first integrator 220 receives the output voltage Vout1 of the inverting amplifying unit 151 of which the ripples are reduced or eliminated from the first smoothing circuit 200. The first integrator 220 outputs a first integration value IV1 by integrating the output voltage Vout1 of the inverting amplifying unit 151 during a first period, according to the integration period control signal ICS.

The first period may be a few to a few thousand horizontal periods or a few to a few ten frame periods. One horizontal period indicates a period in which data voltages are supplied to pixels P coupled to any one gate line of the display panel 10. One frame period indicates a period in which data voltages are supplied to all the pixels P of the display panel 10.

The second integrator 230 receives the integration period control signal ICS from the integration period controller 240. The second integrator 230 receives output voltage Vout2 of the non-inverting amplifying unit 152, from which the ripples are reduced or eliminated, from the second smoothing circuit 210. The second integrator 230 outputs a second integration value IV2 by integrating the output voltage Vout2 of the non-inverting amplifying unit 152 during the first period based on integration period control signal ICS.

The integration period controller 240 receives a horizontal synchronization signal Hsync or vertical synchronization signal Vsync. The horizontal synchronization signal Hsync is a signal having a cycle of one horizontal period. The vertical synchronization signal Vsync is a signal having a cycle of one frame period.

The integration period controller 240 may control the first period (as the integration period) to be, for example, a few to a few thousand horizontal periods. This may be accomplished by counting pulses of the horizontal synchronization signal Hsync. In this case, the integration period controller 240 may output integration period control signal ICS indicating P (P is a natural number) horizontal period(s) to the first and second integrators 220 and 230. The P horizontal period(s) may be previously determined, for example, through experiments or based on the requirements of an intended application.

Alternatively, the integration period controller 240 may control the first period (as the integration period) to be a few to a few ten frame periods. This may be accomplished by counting pulses of the vertical synchronization signal Vsync. In this case, the integration period controller 240 may output integration period control signal ICS indicating Q (Q is a natural number) frame period(s) to the first and second integrators 220 and 230. The Q frame period(s) may be previously determined, for example, through experiments or based on the requirements of an intended application. (See operation S202 in FIG. 7).

Third, the comparator 250 receives the first integration value IV1 from the first integrator 220, and receives the second integration value IV2 input from the second integrator 230. The comparator 250 compares the first and second integration values IV1 and IV2, and outputs variable resistance control signal VRAS based on the result of the comparison.

When the first integration value IV1 is greater than the second integration value IV2, noise of the output signal Vout1 of the inverting amplifying unit 151 may be greater than that of the output signal Vout2 of the non-inverting amplifying unit 152. When the first integration value IV1 is greater than the second integration value IV2, the comparator 250 outputs variable resistance control signal VRAS to increase the resistance value of each of the first and second variable resistors VR1 and VR2.

Therefore, when the first integration value IV1 is greater than the second integration value IV2, the first amplification ratio of the inverting amplifying unit 151 and the second amplification ratio of the non-inverting amplifying unit 152 are increased. Thus, it is possible to decrease the difference between noise of the output signal Vout1 of the inverting amplifying unit 151 and noise of the output signal Vout2 of the non-inverting amplifying unit 152.

In one embodiment, noise of the output signal Vout1 of the inverting amplifying unit 151 may correspond to noise of the display panel 10. Also, noise of the output signal Vout2 of the non-inverting amplifying unit 152 may correspond to noise of the first compensation power voltage VREF_COMP. Given this correspondence, it is therefore possible to reduce, or even minimize, the difference between noise of the display panel 10 and noise of the first compensation power voltage VREF_COMP. Accordingly, when the first compensation power voltage is supplied to the first power voltage line of the display panel, noise of the first compensation power voltage can be almost completely, if not entirely, offset by noise of the display panel. (See operations S203 and S204 in FIG. 7).

When the first integration value IV1 is less than the second integration value IV2, noise of the output signal Vout1 of the inverting amplifying unit 151 is less than that of the output signal Vout2 of the non-inverting amplifying unit 152. In this case, the comparator 250 outputs the variable resistance control signal VRAS in order to decrease the resistance value of each of the first and second variable resistors VR1 and VR2. Therefore, when the first integration value IV1 is less than the second integration value IV2, the first amplification ratio of the inverting amplifying unit 151 and the second amplification ratio of the non-inverting amplifying unit 152 are decreased.

Thus, it is possible to decrease the difference between noise of the output signal Vout1 of the inverting amplifying unit 151 and noise of the output signal Vout2 of the non-inverting amplifying unit 152. That is, it is possible to reduce, or even minimize, the difference between noise of the display panel 10 and noise of the first compensation power voltage VREF_COMP. Accordingly, when the first compensation power voltage is supplied to the first power voltage line of the display panel, noise of the first compensation power voltage can be almost completely, or even entirely, offset by noise of the display panel. (See operations S205 and S206 in FIG. 7).

As described with reference to FIGS. 6 and 7, in one embodiment, the resistance value of each of the first and second variable resistors VR1 and VR2 is controlled by comparing the first integration value IV1 (corresponding to an integration value of the output voltage Vout1 of the inverting amplifying unit 151) with the second integration value IV2 (corresponding to an integration value of the output voltage Vout2 of the non-inverting amplifying unit 152). As a result, it is possible to control the first amplification ratio of the inverting amplifying unit 151 and the second amplification ratio of the non-inverting amplifying unit 152. Through this control, it is possible to reduce, or even minimize, the difference between noise of the display panel 10 and noise of the first compensation power voltage VREF_COMP.

By way of summation and review, according to one embodiment, the first feedback power voltage (which includes noise of the display panel) is fed back from the display panel, and the first compensation power voltage (obtained by compensating for noise of the display panel) is generated using the first feedback power voltage. The generated first compensation power voltage is supplied to the first power voltage line. As a result, it is possible to prevent deterioration of picture quality caused by noise of the display panel.

Further, the resistance value of each of the first and second variable resistors may be controlled by comparing the first integration value (corresponding to an integration value of the output voltage of the inverting amplifying unit in the first power voltage compensation unit) with the second integration value (corresponding to an integration value of the output voltage of the non-inverting amplifying unit in the first power voltage compensation unit). As a result, it is possible to control the first amplification ratio of the inverting amplifying unit and the second amplification ratio of the non-inverting amplifying unit. Accordingly, it is possible to reduce, or even minimize, the difference between noise of the display panel and noise of the first compensation power voltage.

The methods and processes described herein may be performed by code or instructions to be executed by a computer, processor, or controller. Because the algorithms that form the basis of the methods (or operations of the computer, processor, or controller) are described in detail, the code or instructions for implementing the operations of the method embodiments may transform the computer, processor, or controller into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, or controller which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting display, comprising:

a display panel including data lines, scan lines, power voltage lines, and pixels arranged at intersections of the data lines and the scan lines;

a data driver to output data voltages to the data lines;

a scan driver to output scan signals to the scan lines;

a power supply source to supply at least a first power voltage to a first power voltage line; and a first power voltage compensation unit to generate a first compensation power voltage based on the first power voltage and a first feedback power voltage from a first power voltage line, the first power voltage compensation unit to output the first compensation power voltage to the first power voltage line, wherein the first power voltage compensation unit includes:

an inverting amplifying unit to inversely amplify a difference between the first feedback power voltage and the first power voltage; and a non-inverting amplifying unit to non-inversely amplify a difference between the first power voltage and an output voltage of the inverting amplifying unit.

2. The display as claimed in claim 1, wherein the inverting amplifying unit includes:

a first operational amplifier (OP-AMP) including an inverting input terminal to receive the first feedback power voltage, a non-inverting input terminal to receive the first power voltage, and an output terminal;

a first resistor coupled to the inverting input terminal of the first OP-AMP; and a first variable resistor coupled between the inverting input terminal and the output terminal of the first OP-AMP.

3. The display as claimed in claim 2, wherein the non-inverting amplifying unit includes:

a second OP-AMP including an inverting input terminal to receive the first power voltage, a non-inverting input terminal to receive the output voltage of the inverting amplifying unit, and an output terminal;

a second resistor coupled to the inverting input terminal of the second OP-AMP; and a second variable resistor coupled between the inverting input terminal and the output terminal of the second OP-AMP.

4. The display as claimed in claim 3, wherein the first power voltage compensation unit further includes a variable resistance control unit to output a variable resistance control signal to control resistance values of the first and second variable resistors.

5. The display as claimed in claim 4, wherein the variable resistance control unit includes:

a first smoothing circuit to reduce a number of ripples of the output voltage of the inverting amplifying unit;

a second smoothing circuit configured to reduce a number of ripples of an output voltage of the non-inverting amplifying unit;

a first integrating circuit to output a first integration value by integrating the output voltage of the inverting amplifying unit during a first period;

a second integrating circuit to output a second integration value by integrating the output voltage of the non-inverting amplifying unit during the first period; and a comparator to output the variable resistance control signal based on a comparison of the first and second integration values.

6. The display as claimed in claim 5, wherein the comparator:

outputs a variable resistance control signal of a first logic level when the first integration value is greater than the second integration value, and outputs a variable resistance control signal of a second logic level when the first integration value is less than the second integration value.

7. The display as claimed in claim 6, wherein each of the first and second variable resistors has a first resistance value when the variable resistance control signal of the first logic level is input, and has a second resistance value less than the first resistance value when the variable resistance control signal of the second logic level is input.

8. The display as claimed in claim 1, wherein each pixel includes:

a scan transistor to supply a data voltage of a data line in response to a scan pulse of a scan line;

a driving transistor to control a drain-source current based on the data voltage supplied to a gate electrode of the driving transistor; and an organic light emitting diode to emit light based on the drain-source current of the driving transistor.

9. The display as claimed in claim 8, wherein the first power voltage is a reference voltage supplied to the gate electrode of the driving transistor before the data voltage is supplied to the gate electrode of the driving transistor.

10. A method for driving an organic light emitting display, the method comprising:

receiving a first power voltage from a power supply source;

receiving a first feedback power voltage from a first power voltage line;

generating a first compensation power voltage based on the first power voltage and the first feedback power voltage; and outputting the first compensation power voltage to the first power voltage line, wherein the generating the first compensation power voltage includes:

inversely amplifying a difference between the first feedback power voltage and the first power voltage; and non-inversely amplifying a difference between the first power voltage and an output voltage of the inverting amplifying unit.

11. The method as claimed in claim 10, wherein generating the first compensation power voltage includes:

outputting a variable resistance control signal to control the resistance value of a first variable resistor of an inverting amplifying unit and the resistance value of a second variable resistor of a non-inverting amplifying unit.

12. The method as claimed in claim 11, wherein outputting of the variable resistance control signal includes:

reducing a number of ripples of the output voltage of the inverting amplifying unit;

reducing a number of ripples of an output voltage of the non-inverting amplifying unit;

outputting a first integration value obtained by integrating the output voltage of the inverting amplifying unit during a first period;

outputting a second integration value obtained by integrating the output voltage of the non-inverting amplifying unit during the first period; and outputting the variable resistance control signal based on a comparison of the first and second integration values.

13. The method as claimed in claim 12, wherein outputting the variable resistance control signal includes:

outputting a variable resistance control signal of a first logic level when the first integration value is greater than the second integration value, and outputting a variable resistance control signal of a second logic level when the first integration value is less than the second integration value.

14. The method as claimed in claim 13, wherein each of the first and second variable resistors has a first resistance value when the variable resistance control signal of the first logic level is input, and a second resistance value less than the first resistance value when the variable resistance control signal of the second logic level is input.

15. The method as claimed in claim 10, wherein:

the display includes a plurality of pixels; and each of the pixels includes:

a scan transistor to supply a data voltage of a data line in response to a scan pulse of a scan line;

a driving transistor to a control drain-source current based on the data voltage supplied to a gate electrode of the driving transistor; and an organic light emitting diode configured to emit light based on the drain-source current of the driving transistor.

16. The method as claimed in claim 15, wherein the first power voltage is a reference voltage supplied to the gate electrode of the driving transistor before the data voltage is supplied to the gate electrode of the driving transistor.

17. A compensator, comprising:

a first input to receive a first power voltage;

a second input to receive a feedback power voltage; and a circuit to generate a compensation power voltage based on the first power voltage and the first feedback power voltage, wherein the first power voltage is to be provided to an organic light emitting display and the feedback power voltage is received from the display, and wherein the circuit outputs the compensation power voltage to a power voltage line of the display, and the circuit includes:

an inverting amplifying unit to inversely amplify a difference between the first feedback power voltage and the first power voltage; and a non-inverting amplifying unit to non-inversely amplify a difference between the first power voltage and an output voltage of the inverting amplifying unit.

18. The compensator of claim 17, wherein the compensation power voltage is output to reduce variation in luminance of pixels in the display.

* * * * *